US008138402B2

(12) United States Patent
Komatsu

(10) Patent No.: US 8,138,402 B2
(45) Date of Patent: Mar. 20, 2012

(54) KEYBOARD MUSICAL INSTRUMENT AND SOLENOID DRIVE MECHANISM

(75) Inventor: Akihiko Komatsu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/718,877

(22) Filed: Mar. 5, 2010

(65) Prior Publication Data

US 2010/0229708 A1 Sep. 16, 2010

(30) Foreign Application Priority Data

Mar. 13, 2009 (JP) ..... 2009-60583

(51) Int. Cl.
*G10F 1/02* (2006.01)

(52) U.S. Cl. ..... 84/22; 84/20

(58) Field of Classification Search ..... 84/22, 20
See application file for complete search history.

(56) References Cited

U.S. PATENT DOCUMENTS 5,200,562 A * 4/1993 Kaneko et al. ..... 84/21
5,652,399 A * 7/1997 Fujiwara et al. ..... 84/21
5,922,983 A * 7/1999 Muramatsu ..... 84/626
5,978,201 A 11/1999 Fujiwara et al.
5,994,632 A * 11/1999 Muramatsu et al. ..... 84/18
6,245,985 B1 * 6/2001 Sasaki et al. ..... 84/658
6,380,469 B2 * 4/2002 Uehara ..... 84/439
6,420,642 B1 * 7/2002 Muramatsu et al. ..... 84/724
6,969,791 B2 * 11/2005 Fujiwara ..... 84/13
6,992,241 B2 * 1/2006 Fujiwara ..... 84/21
7,235,727 B2 * 6/2007 Fujiwara ..... 84/23
7,279,630 B2 * 10/2007 Sasaki et al. ..... 84/723
7,285,715 B2 * 10/2007 Sasaki et al. ..... 84/737
7,314,995 B2 * 1/2008 Muramatsu ..... 84/744
7,361,828 B2 * 4/2008 Sasaki ..... 84/743
7,390,956 B2 * 6/2008 Fujiwara ..... 84/615
7,411,124 B2 * 8/2008 Muramatsu ..... 84/615
7,435,895 B2 * 10/2008 Muramatsu ..... 84/741
7,473,841 B2 * 1/2009 Fujiwara ..... 84/615
7,521,627 B2 * 4/2009 Sasaki ..... 84/735
7,667,116 B2 * 2/2010 Yamashita et al. ..... 84/20
7,718,871 B1 * 5/2010 Stahnke ..... 84/21
7,786,368 B2 * 8/2010 Muramatsu ..... 84/615
7,843,575 B1 * 11/2010 Starkey ..... 356/614
7,919,708 B2 * 4/2011 Komatsu ..... 84/746
7,943,843 B2 * 5/2011 Komatsu ..... 84/615
7,947,887 B2 * 5/2011 Yaguchi ..... 84/439
7,977,564 B2 * 7/2011 Takigawa ..... 84/670
8,013,233 B2 * 9/2011 Komatsu ..... 84/724
2009/0235810 A1 * 9/2009 Yaguchi ..... 84/626
2010/0229708 A1 * 9/2010 Komatsu ..... 84/22
2010/0236388 A1 * 9/2010 Komatsu ..... 84/626

* cited by examiner

*Primary Examiner* — Elvin G Enad
*Assistant Examiner* — Robert W Horn
(74) *Attorney, Agent, or Firm* — Morrison & Foerster LLP

(57) ABSTRACT

A keyboard musical instrument has a solenoid including a plunger and a coil into which the plunger is inserted, a drive unit for applying voltage to the solenoid, and a key which moves together with the plunger, and on which a force generated by the solenoid is exerted. The drive unit includes a position detector for detecting position of the key in the direction in which the key is depressed or released. By varying voltage which is to be applied to the solenoid in accordance with the position of the key detected by the position detector while the key is in motion, the drive unit varies the force which is to be generated by the solenoid.

2 Claims, 15 Drawing Sheets

KEYBOARD MUSICAL INSTRUMENT AND SOLENOID DRIVE MECHANISM

BACKGROUND OF THE INVENTION

1. Field of the Invention

The present invention relates to a keyboard musical instrument and a solenoid drive mechanism.

2. Description of the Related Art

As a key-depression drive mechanism of a keyboard musical instrument for automatic performance, for example, a solenoid is used (for example, Japanese Patent Publication No. 3799706). In many cases, in order to obtain a large force for retaining a key at a finish position (hereafter referred to as an end position) where the key is situated after a depression of the key, the solenoid is designed such that a force generated by the solenoid at the end position is larger than that generated at an initial position (hereafter referred to as a rest position) where the key is situated before the depression thereof (in other words, such that the solenoid is efficient). Hereafter a force generated by a solenoid is referred as a solenoid force. When the key is situated near the rest position and the solenoid force is small, however, the response in the early stage of the driving for key-depression is not fast, resulting in difficulty in performance expressions which require quick passages.

In addition, a solenoid is used for exerting a sense of force in response to a player's depression of a key, for example. In order to enrich performance expressions on a keyboard musical instrument, for example, it is desired to improve the control over a solenoid force.

SUMMARY OF THE INVENTION

An object of the present invention is to provide a keyboard musical instrument incorporating a solenoid having improved control over a solenoid force, and a drive mechanism of such a solenoid.

According to an aspect of the present invention, there is provided a keyboard musical instrument including a solenoid having a plunger and a coil into which the plunger is inserted; a drive unit for applying voltage to the solenoid; and a key which moves together with the plunger, and on which a force generated by the solenoid is exerted, wherein the drive unit includes a position detector for detecting position of the key in a direction in which the key is depressed or released; and the drive unit varies the solenoid force by varying voltage which is to be applied to the solenoid in accordance with the position of the key detected by the position detector while the key is in motion.

By varying the voltage applied to the solenoid according to the key position to vary the solenoid force, the present invention enhances the driving of key-depression for automatic performance and the control over the sense of force exerted in order to resist a player's depression of a key, for example, also enriching performance expressions on the keyboard musical instrument.

DESCRIPTION OF THE PREFERRED EMBODIMENT a. First Embodiment

Figure 1A:
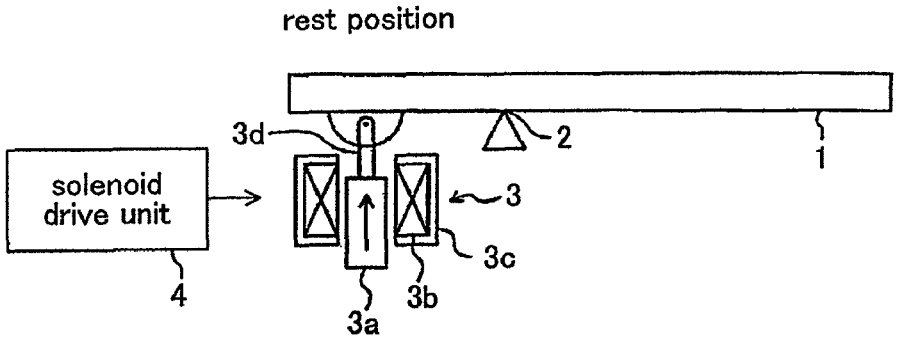
FIG. 1A is a schematic sectional view indicative of a key of a keyboard musical instrument according to a first embodiment, the key being situated at the rest position.
Figure 1B:
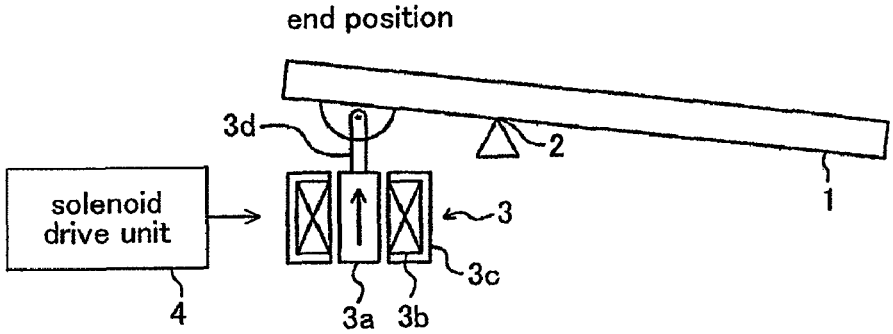
FIG. 1B is a schematic sectional view indicative of the key of the keyboard musical instrument according to the first embodiment, the key being situated at the end position.

A keyboard musical instrument according to the first embodiment of the present invention will now be described. The keyboard musical instrument of the first embodiment is the one for automatic performance (automatic key-depression). FIG. 1A and FIG. 1B are schematic sectional views indicative of a key situated at the initial position (i.e., the rest position) before an action of key-depression and at the finish position (i.e., the end position) after the action of key-depression, respectively. Although the keyboard musical instrument has a multiplicity of keys (88 keys, for example), one of the keys is indicated as a representative.

As indicated in FIG. 1A and FIG. 1B, a key 1 pivots about a fulcrum 2. In these figures, the side where a player is placed (the right side in these figures) with respect to the key 1 is regarded as the front. Below the rear of the key 1 with respect to the fulcrum 2, a solenoid 3 is placed. The solenoid 3 includes a plunger 3*a*, a coil 3*b*, a yoke 3*c* and a coupling rod (coupling member) 3*d*. The plunger 3*a*, which is made of a magnetic substance such as iron, for example, is inserted into the coil 3*b* so that the plunger 3*a* can move upward and downward.

When the coil 3*b* is energized, magnetic flux is produced to generate a force drawing the plunger 3*a* into the coil 3*b*, so that the plunger 3*a* is moved. In order to form a magnetic circuit, the yoke 3*c* is arranged to cover the upper and lower sides and the outer side surfaces. The coupling rod 3*d* is made of a non-magnetic substance such as plastic or brass. The plunger 3*a* is mounted to the coupling rod 3*d*. The coupling rod and the plunger may be molded in one piece from iron or the like so that the plunger part can be pulled. Under the condition in which a certain amount of voltage is applied to the coil 3*b* with a certain amount of current flowing in the coil 3*b*, the deeper the plunger 3*a* is pulled into the coil 3*b* (the narrower the gap between the plunger 3*a* and the yoke 3*c* is), the larger the force generated by the solenoid 3 (i.e., the solenoid force) is.

The solenoid 3 of the first embodiment is a push type solenoid in which the plunger 3*a* is pressed up by energization. The coupling rod 3*d* connects the plunger 3*a* with the key 1 so that the movement of the plunger 3*a* will be synchronized with the movement of the key 1. A solenoid drive unit 4 drives the solenoid 3. When the key 1 is situated in the end position, the plunger 3*a* is pulled into the coil 3*b* most deeply. When the key 1 is situated in the rest position, the plunger 3*a* is pulled into the coil 3*b* partway from below. In these cases, provided a certain amount of voltage is constantly applied to the coil 3*b* with a certain amount of current flowing in the coil 3*b*, the solenoid 3 generates the largest solenoid force when the key 1 is situated in the end position. In other words, the solenoid 3 works most efficiently when the key 1 is situated in the end position. Under the same condition, when the key 1 is situated in the rest position, the solenoid 3 generates a solenoid force smaller than that generated when the key 1 is situated in the end position.

In a state where the key 1 is situated in the rest position, by the start of energization of the coil 3*b*, the key 1 is pressed from below by the plunger 3*a* through the coupling rod 3*d*, resulting in an action of key-depression. By the continuous energization of the coil 3*b* following the key 1 reaching the end position, the retention of the depression of the key 1 results in a performance expression in which a tone sustains. The means for making the key 1 recover to the rest position, which is realized by a spring or a weight, for example, makes the key 1 recover to the rest position.

Because a large force is necessary in order to retain the state where the key 1 has been depressed to be in the end position, it is preferable that the solenoid force be large when the key 1 is situated in the end position. If the solenoid force were small when the key 1 is in the rest position, on the other hand, it would be impossible to quicken the initial movement of the depression of the key 1, making it difficult to realize performance expressions which require quick passages. As explained below, therefore, the first embodiment enhances the solenoid force in states where the key 1 is situated near the rest position.

Figure 2:
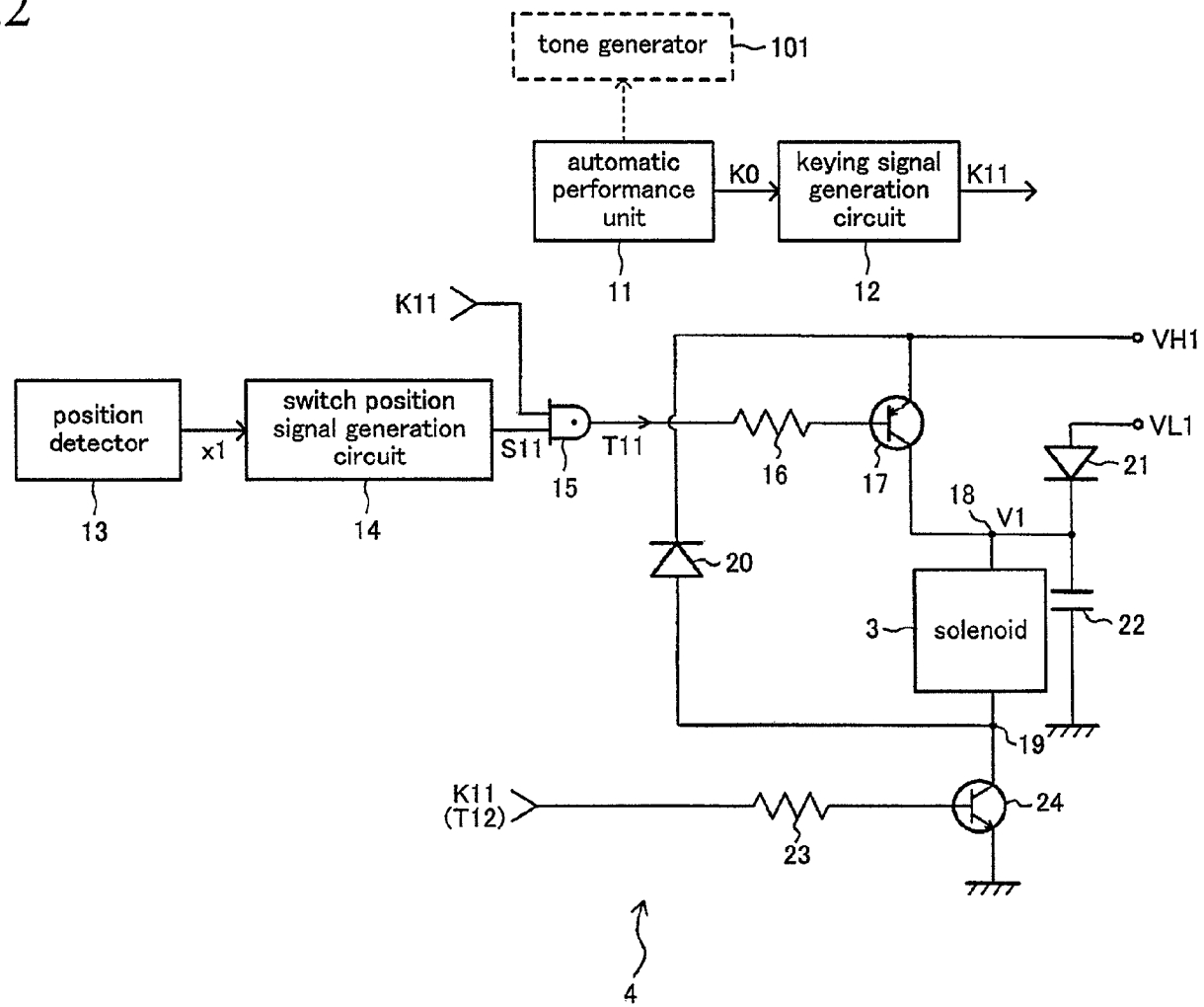
FIG. 2 is an equivalent circuit diagram indicating a schematic configuration of a solenoid drive unit of the first embodiment.

Next, the configuration of the solenoid drive unit 4 of the first embodiment and the scheme for driving the solenoid of the first embodiment will be described. FIG. 2 is an equivalent circuit diagram indicating a schematic configuration of the solenoid drive unit 4 of the first embodiment.

An automatic performance unit 11 outputs automatic performance data K0. The automatic performance data K0 includes note information, key-on timing information and key-off timing information. On the basis of the automatic performance data K0, a keying signal generation circuit 12 generates a keying signal K11 which rises at a key-on timing and falls at a key-off timing. The automatic performance data K0 is output to a tone generator 101 as well so that the tone generator 101 can reproduce musical tones on the basis of the automatic performance data K0.

A position detector 13 for detecting the position of the plunger 3*a* of the solenoid 3 (or the position of a member of the coupling rod 3*d*, the key 1 or the like which moves together with the plunger 3*a*) detects the position of the key 1 in the direction in which the key 1 is depressed or released, the position ranging from the rest position to the end position. The position detector 13 then outputs a key position signal x1 indicative of the detected position of the key 1. As the position detector 13, a magnetic position sensor or the like can be employed. A switch position signal generation circuit 14 receives the key position signal x1 output from the position detector 13 and generates a switch position signal S11. At some point from the rest position to the end position of the key 1 (e.g., at the midpoint), a switch position is provided. The switch position signal S11 rises at the switch position on a key-depression, and falls at the switch position on a key-release.

A voltage switch signal generation circuit 15, which is an AND circuit, for example, inputs the keying signal K11 and the switch position signal S11 and outputs a voltage switch signal T11 which is the result of an AND calculation. In other words, the voltage switch signal T11, which is high if both the keying signal K11 and the switch position signal S11 are high, rises at a switch position reach timing on a key-depression, and falls at a key-off timing on a key-release.

The voltage switch signal T11 is applied to a base of a pnp transistor 17 through a resistor 16. An emitter and a collector of the pnp transistor 17 are connected to a high power supply voltage VH1 and a power supply voltage terminal 18 of the solenoid 3 (coil 3*a*), respectively. A low power supply voltage VL1 which is lower than the high power supply voltage VH1 is connected to the power supply voltage terminal 18 of the solenoid 3 through a diode 21. In this case, the p-pole of the diode 21 is connected to the low power supply voltage VL1, whereas the n-pole of the diode 21 is connected to the power supply voltage terminal 18 of the solenoid 3. Furthermore, the n-pole of the diode 21 is connected to one of the terminals of a capacitor 22, with the other terminal of the capacitor 22 being grounded.

The keying signal K11 is applied, as an energization switch signal T12, to a base of an npn transistor 24 through a resistor 23. A collector of the npn transistor 24 is connected to a ground voltage terminal 19 of the solenoid 3 (coil 3*a*), with an emitter of the npn transistor 24 being grounded. Furthermore, the ground voltage terminal 19 of the solenoid 3 is connected to the high power supply voltage VH1 through a protection diode 20. In this case, the p-pole of the diode 20 is connected to the ground voltage terminal 19 of the solenoid 3, with the n-pole of the diode 20 being connected to the high power supply voltage VH1.

Figure 3:
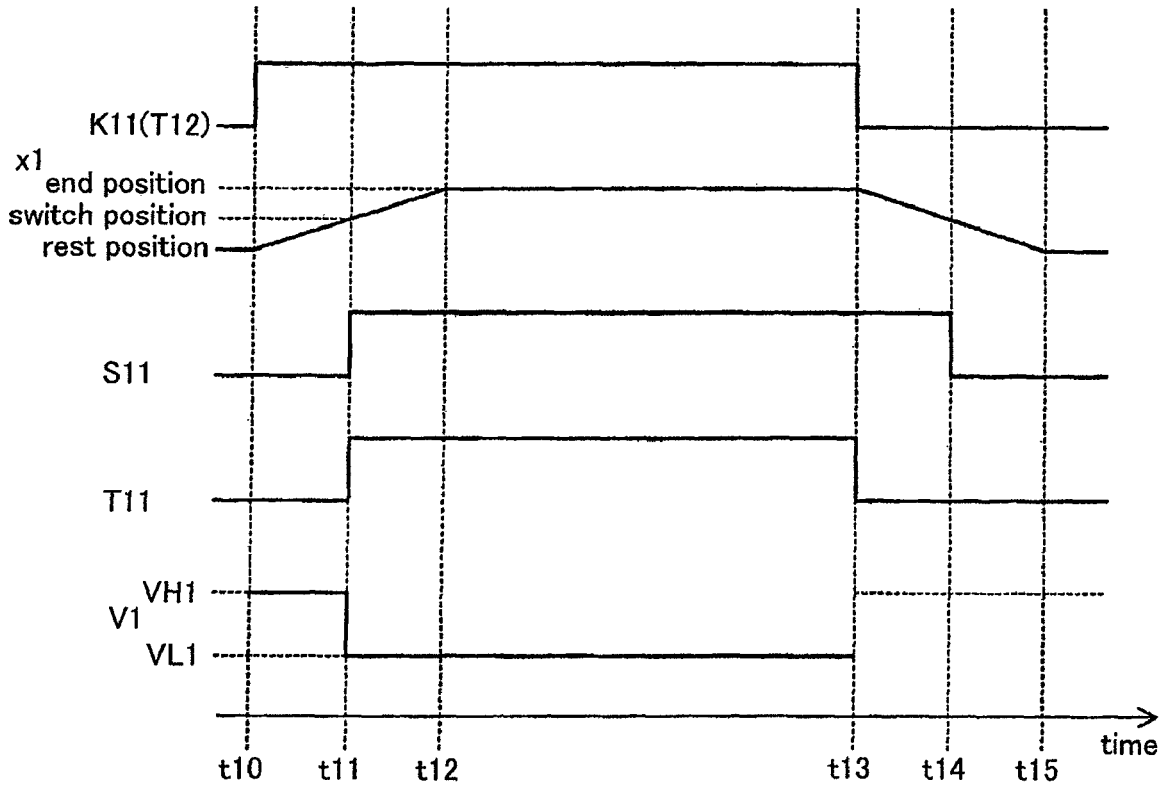
FIG. 3 is a timing chart schematically indicating a scheme for driving a solenoid of the first embodiment.

Referring to FIG. 3 as well, the scheme for driving the solenoid of the first embodiment will now be described. FIG. 3 is a timing chart schematically indicating the scheme for driving the solenoid of the first embodiment. FIG. 3 indicates the keying signal K11 (the energization switch signal T12), the key position x1, the switch position signal S11, the voltage switch signal T11 and a power supply voltage V1 connected to the power supply voltage terminal 18 of the solenoid 3.

At time t10, which is a key-on timing, the keying signal K11 and the energization switch signal T12 rise. At time t13, which is a key-off timing, the keying signal K11 and the energization switch signal T12 fall. From time t10 until time t13, the npn transistor 24 is on, so that the ground voltage terminal 19 of the solenoid 3 is grounded to allow energization of the solenoid 3.

At time t10, however, the key position x1 has not reached the switch position, so that the switch position signal S11 is low, with the voltage switch signal T11 also being low. While the voltage switch signal T11 is low, the pnp transistor 17 is on to connect the high power supply voltage VH1 to the power supply voltage terminal 18 of the solenoid 3. To the diode 21 placed between the power supply voltage terminal 18 and the low power supply voltage VL1, a reverse bias is applied. From time t10 until time t11, the high power supply voltage VH1 is applied to the solenoid 3 to energize the solenoid 3.

At time t11, the key position x1 reaches the switch position, so that the switch position signal S11 rises, resulting in the voltage switch signal T11 also rising. By the rise of the voltage switch signal T11, the voltage switch signal T11 conforms to the voltage of the high power supply voltage VH1, so that the pnp transistor 17 is turned off to connect the low power supply voltage VL1 to the power supply voltage terminal 18 of the solenoid 3. From time t11 at which the pnp transistor 17 is turned off until time t13 of the key-off timing, the low power supply voltage VL1 is applied to the solenoid 3 to energize the solenoid 3.

The key position x1 reaches the end position at time t12, and is kept at the end position until time t13. While the key is kept at the end position, the pnp transistor 17 is off, so that the low power supply voltage VL1 is applied to the solenoid 3.

At time t13 of the key-off timing, the keying signal K11 and the energization switch signal T12 fall to terminate the energization of the solenoid 3. At time t13, the voltage switch signal T11 also falls to turn on the pnp transistor 17, so that the power supply voltage V1 which is to be connected to the power supply voltage terminal 18 of the solenoid 3 switches from the low power supply voltage VL1 to the high power supply voltage VH1. After time t13, the energization switch signal T12 is low, so that the solenoid 3 will not be energized. In FIG. 3, the voltage V1 outside energized time periods is indicated by dotted lines.

At time t14, the key position x1 returns from the end position side to the switch position, so that the switch position signal S11 falls. At time t15, the key position x1 returns to the rest position.

Figure 4:
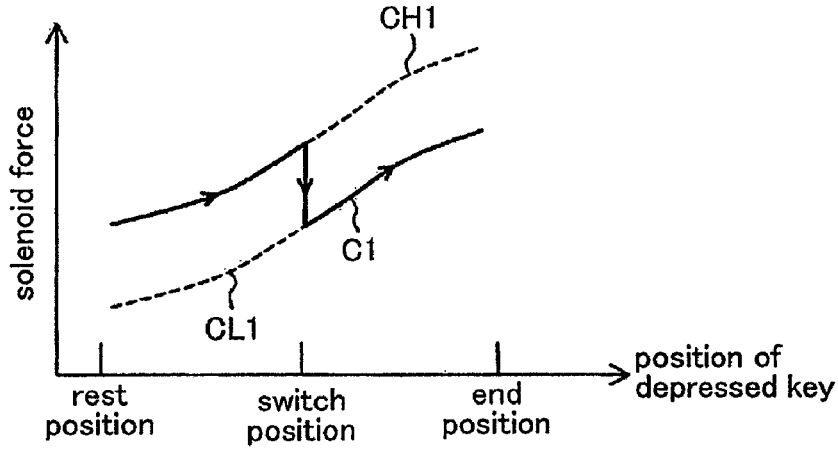
FIG. 4 is a graph schematically indicating the relationship between the key position of a depressed key and a solenoid force of the first embodiment.

FIG. 4 is a graph schematically indicating the relationship between the key position of a depressed key and the solenoid force of the first embodiment. A curve CH1 indicates the solenoid force of a case where the high power supply voltage VH1 is applied to the power supply voltage terminal 18 of the solenoid 3 with a certain amount of current flowing in the solenoid 3. A curve CL1 indicates the solenoid force of a case where the low power supply voltage VL1 is applied to the power supply voltage terminal 18 of the solenoid 3 with a certain amount of current flowing in the solenoid 3. As indicated by a solid line, a curve C1 which switches at the switch position from the curve CH1 to the curve CL1 indicates the solenoid force obtained by the solenoid drive scheme of the first embodiment.

As described above, the solenoid of the first embodiment has a property that the solenoid force of the case where the key 1 is situated in the end position is larger than that of the case where the key 1 is situated in the rest position, under the condition in which a certain amount of voltage is applied to the solenoid 3 with a certain amount of current flowing in the solenoid 3. First, a case in which the low power supply voltage VL1 is applied constantly from the rest position to the end position will be given as an example comparison. In order to ensure an adequate solenoid force from the switch position to the end position (in the vicinity of the end position), the low power supply voltage VL1 is selected. However, the low power supply voltage VL1 is not enough to ensure an adequate solenoid force from the rest position to the switch position (in the vicinity of the rest position). By applying the high enough high power supply voltage VH1 to the solenoid 3 from the rest position to the switch position, therefore, the solenoid drive scheme of the first embodiment ensures a desirably large solenoid force. Therefore, the solenoid drive scheme of the first embodiment enhances the solenoid force generated near the rest position, for example, improving the response of the key 1 to facilitate performance expressions which require quick passages, for example.

As the other example comparison, a case in which the high power supply voltage VH1 is applied constantly from the rest position to the end position will be given. In order to ensure an adequate solenoid force from the rest position to the switch position (in the vicinity of the rest position), the high power supply voltage VH1 is selected. From the switch position to the end position, however, the solenoid 3 is to be driven with an unnecessarily high voltage, which is not desirable in terms of reduction in power consumption, for example. By applying the low power supply voltage VL1 which is low but ensures a necessary solenoid force from the switch position to the end position, the solenoid drive scheme of the first embodiment achieves reduction in power consumption, for example.

b. Second Embodiment

Figure 5A:
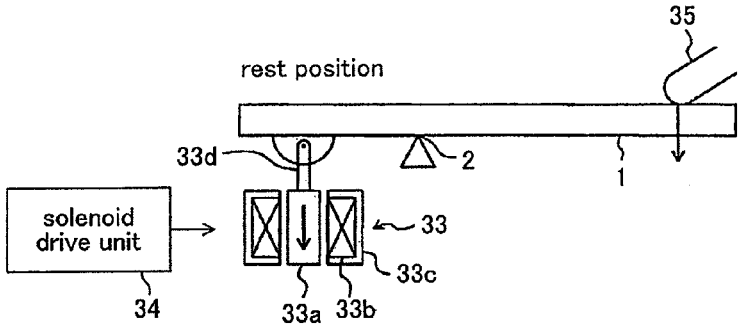
FIG. 5A is a schematic sectional view indicative of the key of keyboard musical instruments according to second through fourth embodiments, the key being situated at the rest position.
Figure 5B:
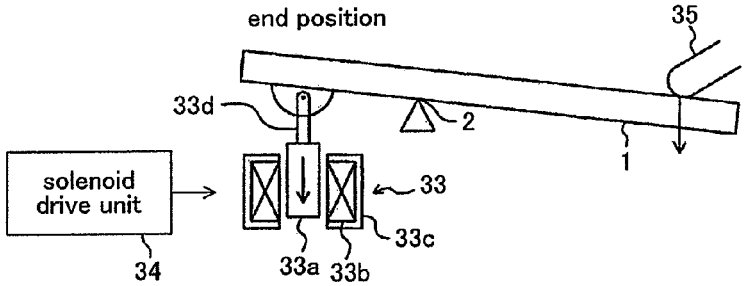
FIG. 5B is a schematic sectional view indicative of the key of the keyboard musical instruments according to the second through fourth embodiments, the key being situated at the end position.

Next, a keyboard musical instrument according to the second embodiment will be described. The keyboard musical instrument of the second embodiment is designed to exert a sense of force (a reaction force) in response to a player's depression of a key. FIG. 5A and FIG. 5B are schematic sectional views indicative of a key situated at the rest position and at the end position, respectively. One of the multiplicity of keys is indicated as a representative.

As indicated in FIG. 5A and FIG. 5B, the key 1 pivots about the fulcrum 2. Below the rear of the key 1 with respect to the fulcrum 2, a solenoid 33 is placed. Similarly to the solenoid 3 of the first embodiment, the solenoid 33 includes a plunger 33*a*, a coil 33*b*, a yoke 33*c* and a coupling rod 33*d*. Although the solenoid 3 of the first embodiment for automatic performance is a push type solenoid in which the plunger 3*a* is pressed up by energization, the solenoid 33 for exerting a reaction force is a pull type solenoid in which the plunger 33*a* is pulled down by energization. The coupling rod 33*d* connects the plunger 33*a* with the key 1 so that the movement of the plunger 33*a* will be synchronized with the movement of the key 1.

According to the solenoid 33 of the second embodiment for exerting a reaction force, when the key 1 is situated in the rest position, the plunger 33*a* is pulled into the coil 33*b* most deeply. When the key 1 is situated in the end position, the plunger 33*a* is pulled partway into the coil 33*b* from above (the plunger 33*a* protrudes upward from the coil 33*b*). In these cases, provided a certain amount of voltage is constantly applied to the coil 33*b* with a certain amount of current flowing in the coil 33*b*, the solenoid 33 generates the largest solenoid force when the key 1 is situated in the rest position. In other words, the solenoid 33 works most efficiently when the key 1 is situated in the rest position. Under the same condition, when the key 1 is situated in the end position, the solenoid 33 generates a solenoid force smaller than that generated when the key 1 is situated in the rest position.

In a state where the key 1 is situated in the rest position, a player's finger 35 depresses the key 1 downward. More specifically, the player's finger 35 depresses a point of the key 1, the point being situated forward of the fulcrum 2. On the start of the depression of the key 1, the energization of the coil 33*b* starts, so that the key 1 is pulled down to exert a reaction force which resists the depression of the key 1. A solenoid drive unit 34 drives the solenoid 33 so that a desired reaction force will be exerted.

Figure 6:
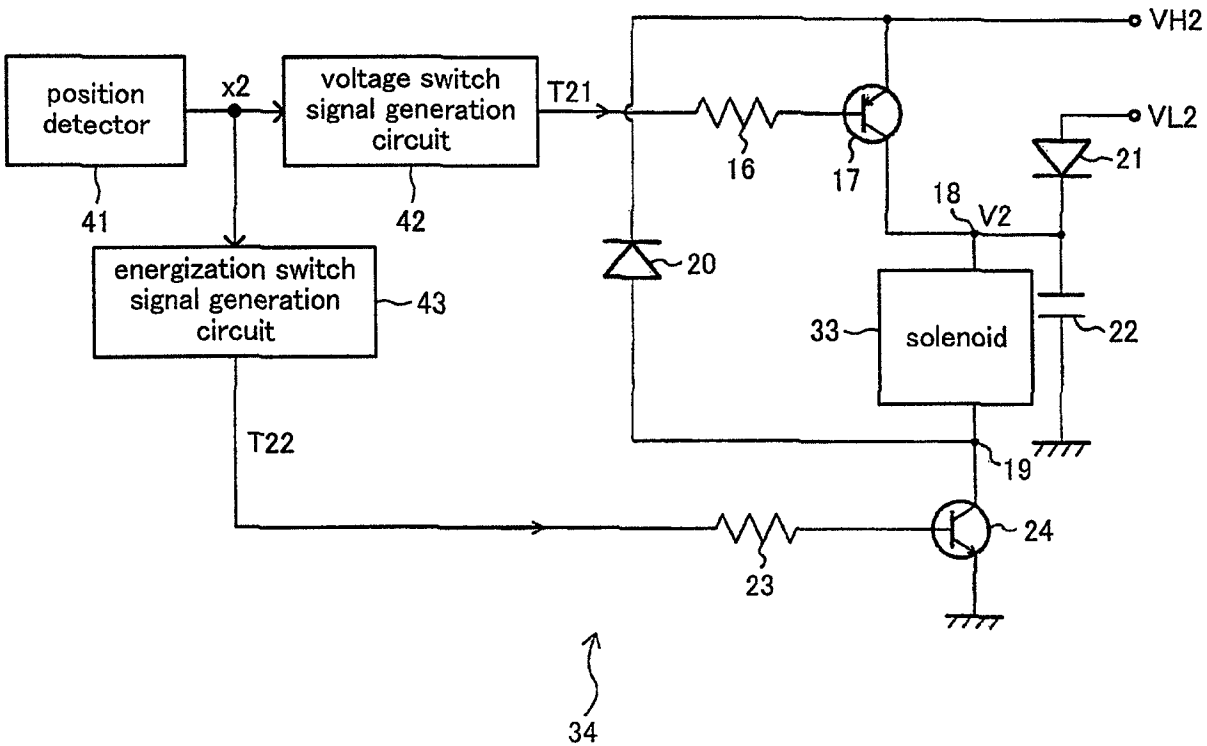
FIG. 6 is an equivalent circuit diagram indicating a schematic configuration of a solenoid drive unit of the second embodiment.

Next, the configuration of the solenoid drive unit 34 of the second embodiment and the scheme for driving the solenoid of the second embodiment will be described. FIG. 6 is an equivalent circuit diagram indicating a schematic configuration of the solenoid drive unit 34 of the second embodiment.

By a player's action of key-depression, a key-depression starts. A position detector 41 for detecting the position of the plunger 33*a* of the solenoid 33 (or the position of a member of the coupling rod, the key or the like which moves together with the plunger 33*a*) detects the position of the key 1 in the direction in which the key 1 is depressed or released, the position ranging from the rest position to the end position. The position detector 41 then outputs a key position signal x2 indicative of the detected position of the key 1. As the position detector 41, a magnetic position sensor or the like can be employed. A voltage switch signal generation circuit 42 receives the key position signal x2 output from the position detector 41 and generates a voltage switch signal T21. At some point from the rest position to the end position of the key 1 (e.g., at the midpoint), a switch position is provided. The voltage switch signal T21 rises at the switch position on a key-depression, and falls at the switch position on a key-release.

The voltage switch signal T21 is applied to the base of the pnp transistor 17 through the resistor 16. The emitter and the collector of the pnp transistor 17 are connected to a high power supply voltage VH2 and the power supply voltage terminal 18 of the solenoid 33 (coil 33*a*), respectively. A low power supply voltage VL2 which is lower than the high power supply voltage VH2 is connected to the power supply voltage terminal 18 of the solenoid 33 through the diode 21. In this case, the p-pole of the diode 21 is connected to the low power supply voltage VL2, whereas the n-pole of the diode 21 is connected to the power supply voltage terminal 18 of the solenoid 33. Furthermore, the n-pole of the diode 21 is connected to one of the terminals of the capacitor 22, with the other terminal of the capacitor 22 being grounded.

An energization switch signal generation circuit 43 receives the key position signal x2 output from the position detector 41 and generates an energization switch signal T22. The position of the key 1 which has been slightly depressed from the rest position is provided as a key-depression detection position. The energization switch signal T22 rises at the key-depression detection position on a key-depression, and falls at the key-depression detection position on a key-release. The energization switch signal T22 is applied to the base of the npn transistor 24 through the resistor 23. The collector of the npn transistor 24 is connected to the ground voltage terminal 19 of the solenoid 33 (coil 33*a*), with the emitter of the npn transistor 24 being grounded. Furthermore, the ground voltage terminal 19 of the solenoid 33 is connected to the high power supply voltage VH2 through the protection diode 20. In this case, the p-pole of the diode 20 is connected to the ground voltage terminal 19 of the solenoid 33, with the n-pole of the diode 20 being connected to the high power supply voltage VH2.

The resistor 16, the pnp transistor 17, the diodes 20, 21, the capacitor 22, the resistor 23 and the npn transistor 24 are connected similarly to the case of the first embodiment. Therefore, these elements are given the same reference numbers as those of the first embodiment. However, the properties of the respective elements can be appropriately selected to suit the second embodiment. Therefore, these elements of the second embodiment do not necessarily have the same properties of those of the first embodiment.

Figure 7:
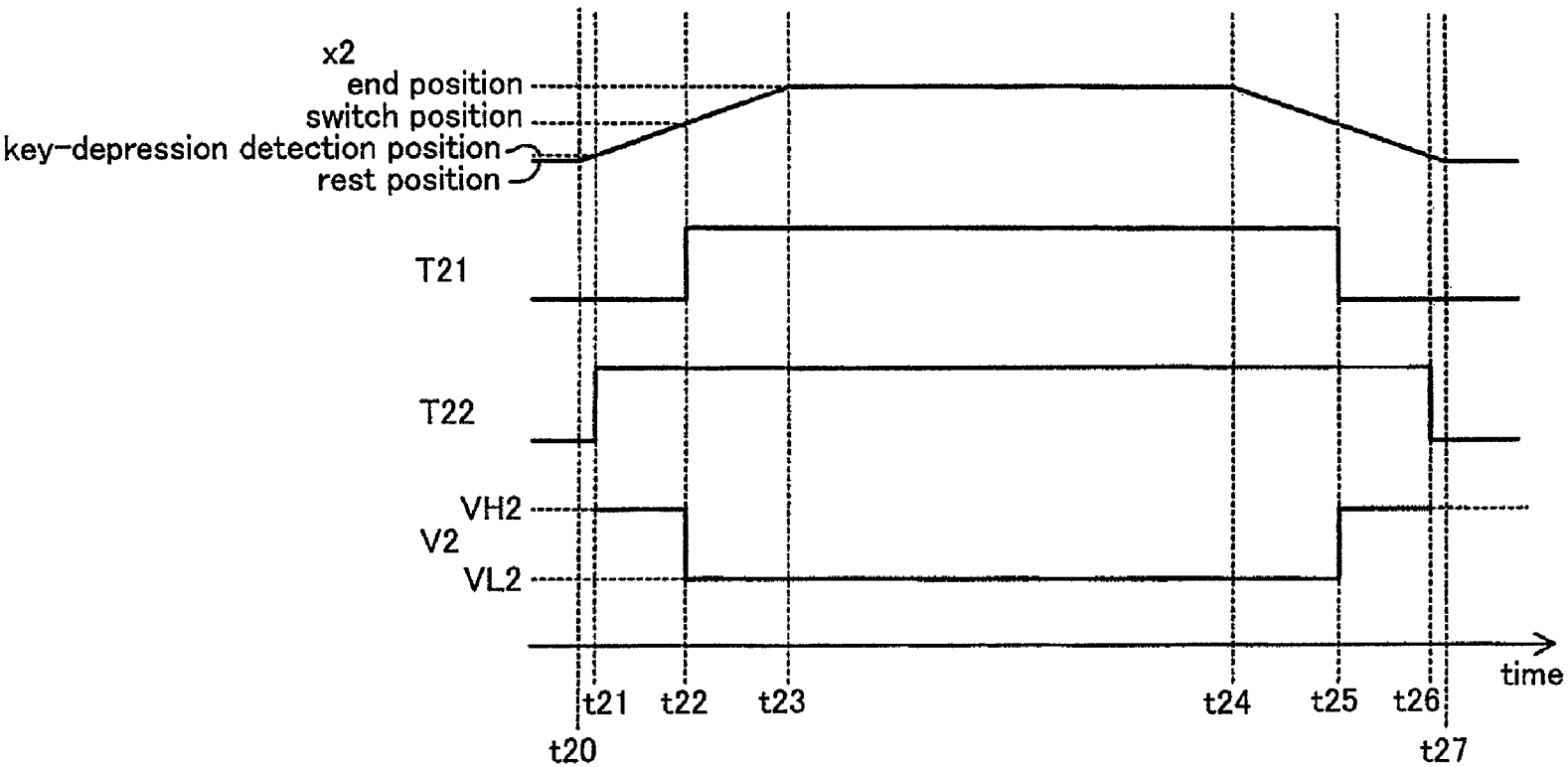
FIG. 7 is a timing chart schematically indicating a scheme for driving a solenoid of the second embodiment.

Referring to FIG. 7 as well, the scheme for driving the solenoid of the second embodiment will now be described. FIG. 7 is a timing chart schematically indicating the scheme for driving the solenoid of the second embodiment. FIG. 7 indicates the key position x2, the voltage switch signal T21, the energization switch signal T22 and a power supply voltage V2 connected to the power supply voltage terminal 18 of the solenoid 33.

At time t20, the player starts a depression of a key. At time t21, the key position x2 reaches the key-depression detection position, so that the energization switch signal T22 rises. At time t26 at which the key is released, the key position x2 returns from the end position side to the key-depression detection position (a key-depression initial position), so that the energization switch signal T22 falls. From time t21 until time t26, the npn transistor 24 is kept "on", so that the ground voltage terminal 19 of the solenoid 33 is grounded to allow energization of the solenoid 33. At time t21, however, the key position x2 has not reached the switch position, so that the voltage switch signal T21 is low, so that the pnp transistor 17 is "on" with the high power supply voltage VH2 being connected to the power supply voltage terminal 18 of the solenoid 33. To the diode 21 placed between the power supply voltage terminal 18 and the low power supply voltage VL2, a reverse bias is applied. From time t21 until time t22, the high power supply voltage VH2 is applied to the solenoid 33 to energize the solenoid 33.

At time 22, the key position x2 reaches the switch position, so that the voltage switch signal T21 rises, with the pnp transistor 17 being turned off to connect the low power supply voltage VL2 to the power supply voltage terminal 18 of the solenoid 33. The key position x2 reaches the end position at time t23, and is kept at the end position until time t24.

At time t24, an action of key-release starts. At time t25, the key position x2 returns from the end position side to the switch position. From time t22 until time t25, the low power supply voltage VL2 is applied to the solenoid 33 to energize the solenoid 33. At time t25, the voltage switch signal T21 falls, with the pnp transistor 17 being turned on to switch the power supply voltage V2 which is to be connected to the power supply voltage terminal 18 of the solenoid 33 from the low power supply voltage VL2 to the high power supply voltage VH2.

At time t26, the key position x2 returns from the end position side to the key-depression detection position, so that the energization switch signal T22 falls to terminate the energization of the solenoid 33. In FIG. 7, the voltage V2 outside energized time periods is indicated by dotted lines. At time t27, the key position x2 returns to the rest position.

Figure 8:
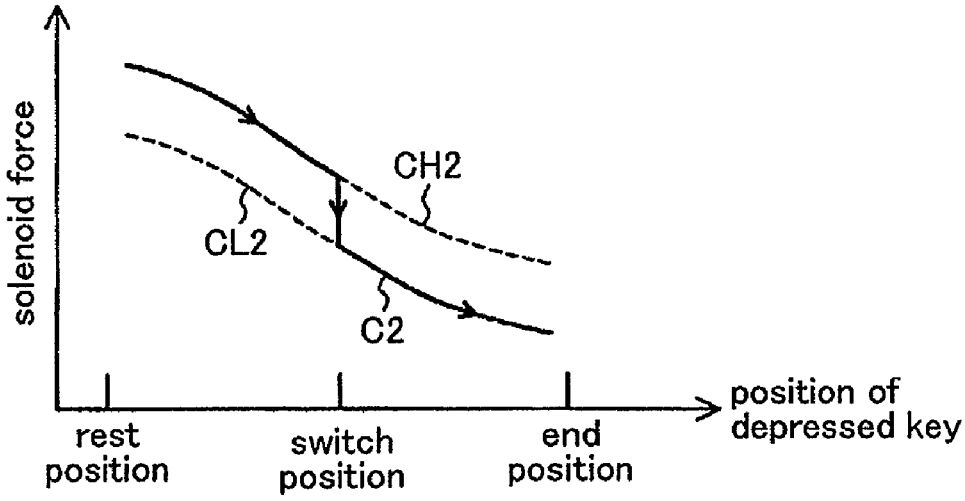
FIG. 8 is a graph schematically indicating the relationship between the key position of a depressed key and a solenoid force of the second embodiment.

FIG. 8 is a graph schematically indicating the relationship between the key position of a depressed key and the solenoid force of the second embodiment. A curve CH2 indicates the solenoid force of a case where the high power supply voltage VH2 is applied to the power supply voltage terminal 18 of the solenoid 33 with a certain amount of current flowing in the solenoid 33. A curve CL2 indicates the solenoid force of a case where the low power supply voltage VL2 is applied to the power supply voltage terminal 18 of the solenoid 33 with a certain amount of current flowing in the solenoid 33. As indicated by a solid line, a curve C2 which switches at the switch position from the curve CH2 to the curve CL2 indicates the solenoid force obtained by the solenoid drive scheme of the second embodiment.

According to the solenoid drive scheme of the second embodiment, during a depression of the key, the power supply voltage V2 is reduced from the high power supply voltage VH2 to the low power supply voltage VL2 at the switch position. Even on a keyboard musical instrument which does not have a drive mechanism for driving hammers, therefore, the solenoid drive scheme of the second embodiment enables sharp decrease of reaction force at some point of a key-depression to allow a player to perceive a sense of touch referred to as tracker touch.

c. Third Embodiment

Next, a keyboard musical instrument according to the third embodiment will be described. Similarly to the keyboard musical instrument of the second embodiment, the keyboard musical instrument of the third embodiment is designed to exert a sense of force (a reaction force) in response to a player's depression of a key. The arrangement of the key and the solenoid is the same as that of the second embodiment, which is indicated in FIGS. 5A and 5B.

According to the third embodiment, however, a reaction force which resists a player's depression of the key is exerted on the basis of a profile of reaction force defined according to the position of the key. The reaction force defined according to the profile is generated by controlling average current flowing in the solenoid 33. More specifically, the third embodiment can control the force of the solenoid 33 by repeatedly switching between the state in which the solenoid is energized and the state in which the solenoid is not energized so that the average current flowing in the solenoid 33 varies, with the force of the solenoid of a case where a certain amount of current (direct current) flows in the solenoid 33 being the largest force. Similarly to the second embodiment, in addition, the third embodiment is able to vary the largest solenoid force according to the key position by switching the voltage which is to be applied to the solenoid. The solenoid drive unit 34 performs such driving.

Figure 9:
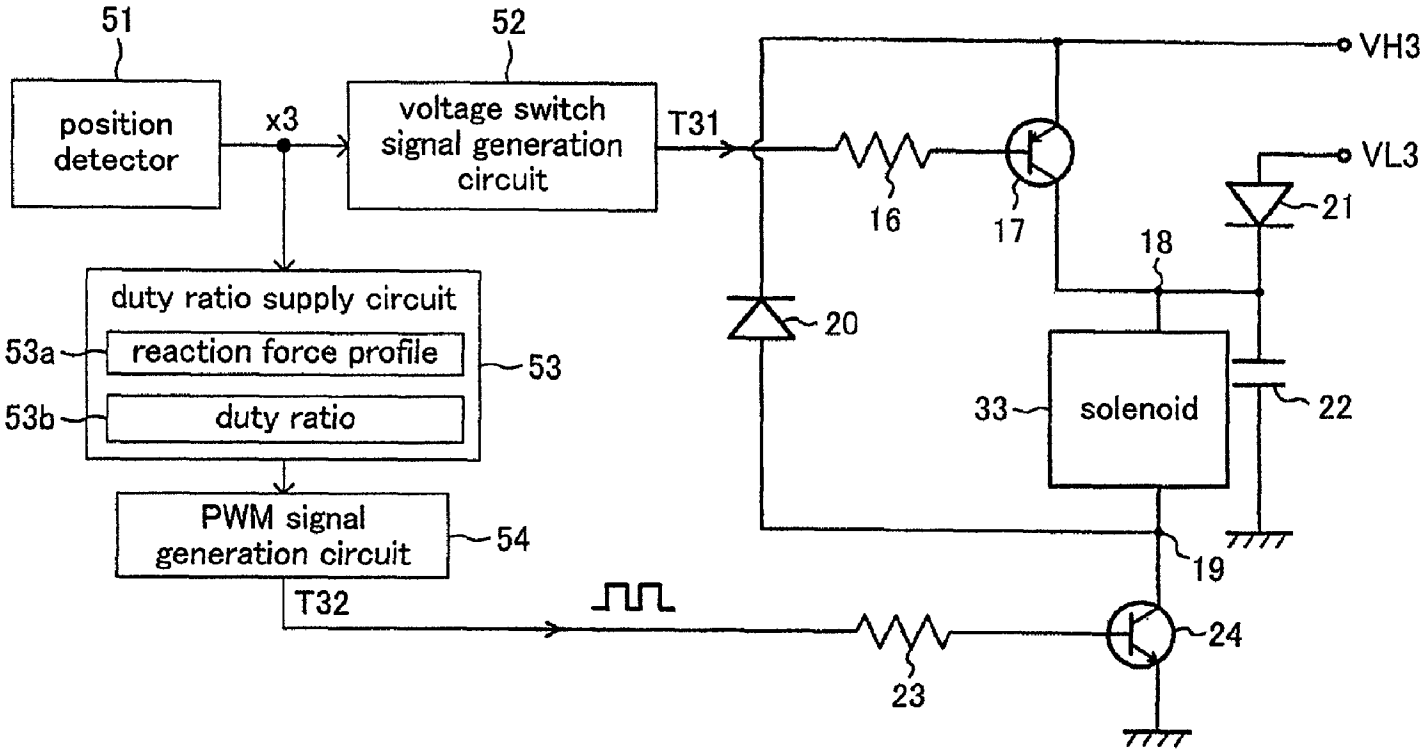
FIG. 9 is an equivalent circuit diagram indicating a schematic configuration of a solenoid drive unit of the third embodiment.

FIG. 9 is an equivalent circuit diagram indicating a schematic configuration of the solenoid drive unit 34 of the third embodiment. The resistor 16, the pnp transistor 17, the diodes 20, 21, the capacitor 22, the resistor 23 and the npn transistor 24 are connected similarly to the case of the second embodiment. However, the properties of the respective elements can be appropriately selected to suit the third embodiment. Therefore, these elements of the third embodiment do not necessarily have the same properties of those of the second embodiment.

Hereafter, a control signal T31 applied to the base of the pnp transistor 17 and a control signal T32 applied to the base of the npn transistor 24 will be described.

By a player's action of depressing a key, a key-depression starts. A position detector 51 detects the position of the key and outputs a key position signal x3 indicative of the position of the key. A voltage switch signal generation circuit 52 receives the key position signal x3 output from the position detector 51 and generates the voltage switch signal T31. At some point from the rest position to the end position (e.g., at the midpoint), a switch position is provided. The voltage switch signal T31 falls at the switch position on a key-depression, and rises at the switch position on a key-release. The voltage switch signal T31 is applied to the base of the pnp transistor 17.

The emitter and the collector of the pnp transistor 17 are connected to a high power supply voltage VH3 and the power supply voltage terminal 18 of the solenoid 33, respectively. A low power supply voltage VL3 which is lower than the high power supply voltage VH3 is connected to the power supply voltage terminal 18 of the solenoid 33 through the diode 21. In this case, the p-pole of the diode 21 is connected to the low power supply voltage VL3, whereas the n-pole of the diode 21 is connected to the power supply voltage terminal 18 of the solenoid 33.

The key position signal x3 output from the position detector 51 is also input to a duty ratio supply circuit 53 which supplies duty ratio of pulse width modulation (PWM) signal. The duty ratio supply circuit 53 has a reaction force profile table 53*a* which relates to the profile of reaction force and a duty ratio table 53*b* which relates to duty ratio. The reaction force profile table 53*a* stores the profile of reaction force (for example, CF3 of FIG. 11 described later) which is to be exerted according to the key position x3, specifically stores the reaction force (solenoid force) which varies according to the key position x3. The duty ratio table 53*b* stores duty ratio for generating a reaction force on the basis of the reaction force profile table 53*a*, specifically stores the duty ratio which varies according to the reaction force (the solenoid force). When the key position signal x3 is input to the duty ratio supply circuit 53 from the position detector 51, at first, the duty ratio supply circuit 53 determines the reaction force (the solenoid force) corresponding to the input key position signal x3 by referring the reaction force profile table 53*a*. Next, the duty ratio supply circuit 53 determines the duty ratio corresponding to the determined reaction force by referring the duty ratio table 53*b*. As a result, the duty ratio supply circuit 53 determines the duty ratio according to the key position x3 to supply the determined duty ratio to a PWM signal generation circuit (energization switch signal generation circuit) 54. By the duty ratio supplied from the duty ratio supply circuit 53, the PWM signal generation circuit (energization switch signal generation circuit) 54 generates a PWM signal (energization switch signal) T32. The energization switch signal T32 is applied to the base of the npn transistor 24.

In accordance with the duty ratio of the PWM signal applied to the base of the npn transistor 24, the state in which the solenoid 33 is energized and the state in which the solenoid 33 is not energized are repeatedly switched. By such iterated switching, the average current flowing in the solenoid 33 is controlled. By increasing the duty ratio, according to the third embodiment, the average current also increases, resulting in an increased solenoid force (reaction force).

Figure 10:
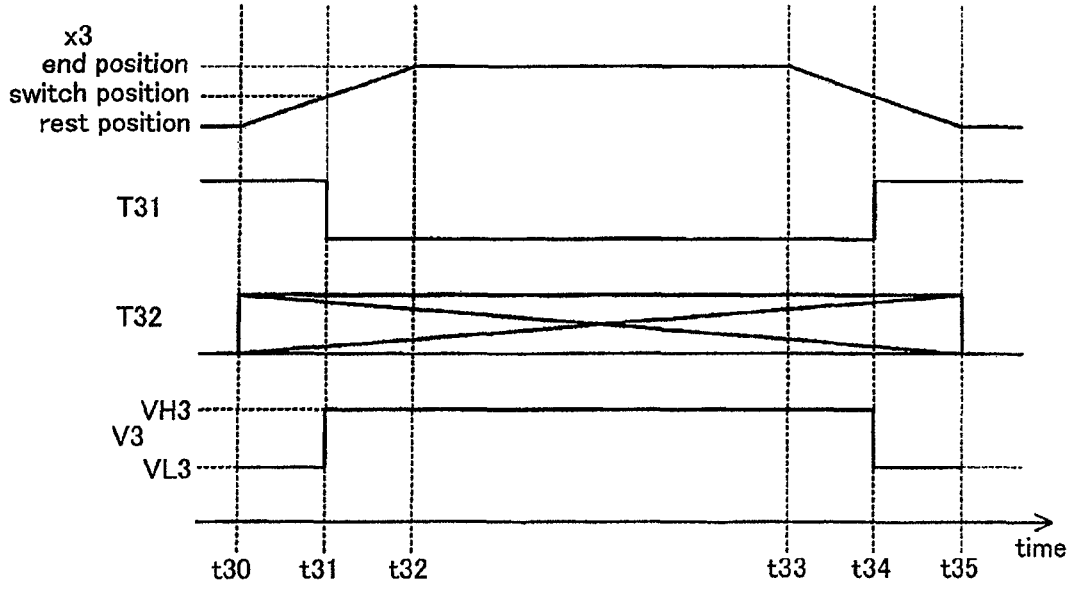
FIG. 10 is a timing chart schematically indicating a scheme for driving a solenoid of the third embodiment.

Referring to FIG. 10 as well, the scheme for driving the solenoid of the third embodiment will now be described. FIG. 10 is a timing chart schematically indicating the scheme for driving the solenoid of the third embodiment. FIG. 10 indicates the key position x3, the voltage switch signal T31, the energization switch signal T32 and a power supply voltage V3 connected to the power supply voltage terminal 18 of the solenoid 33.

At time t30, the player starts a depression of a key, so that the key position x3 moves from the rest position toward the end position. At time t35 at which the key is released, the key position x3 returns from the end position side to the rest position. From time t30 until time t35, the energization switch signal T32 of the PWM signal is applied to the base of the npn transistor 24 to repeat the on-state and the off-state of the npn transistor 24 by the duty ratios based on the respective key positions x3, that is, the state in which the solenoid is energized and the state in which the solenoid is not energized.

At time t30, however, the key position x3 has not reached the switch position, resulting in the voltage switch signal T31 being the same voltage as the high power supply voltage VH3 (being high). As a result, the pnp transistor 17 exhibits the off-state, so that the low power supply voltage VL3 is connected to the power supply voltage terminal 18 of the solenoid 33.

At time t31, the key position x3 reaches the switch position, so that the voltage switch signal T31 falls, with the pnp transistor 17 being turned on to connect the high power supply voltage VH3 to the power supply voltage terminal 18 of the solenoid 33. The key position x3 reaches the end position at time t32, and is kept at the end position until time t33.

At time t33, an action of key-release starts. At time t34, the key position x3 returns from the end position side to the switch position, so that the voltage switch signal T31 rises to turn off the pnp transistor 17 to switch the power supply voltage V3 which is to be connected to the power supply voltage terminal 18 of the solenoid 33 from the high power supply voltage VH3 to the low power supply voltage VL3. At time t35, the key position x3 returns from the end position side to the rest position.

Figure 11:
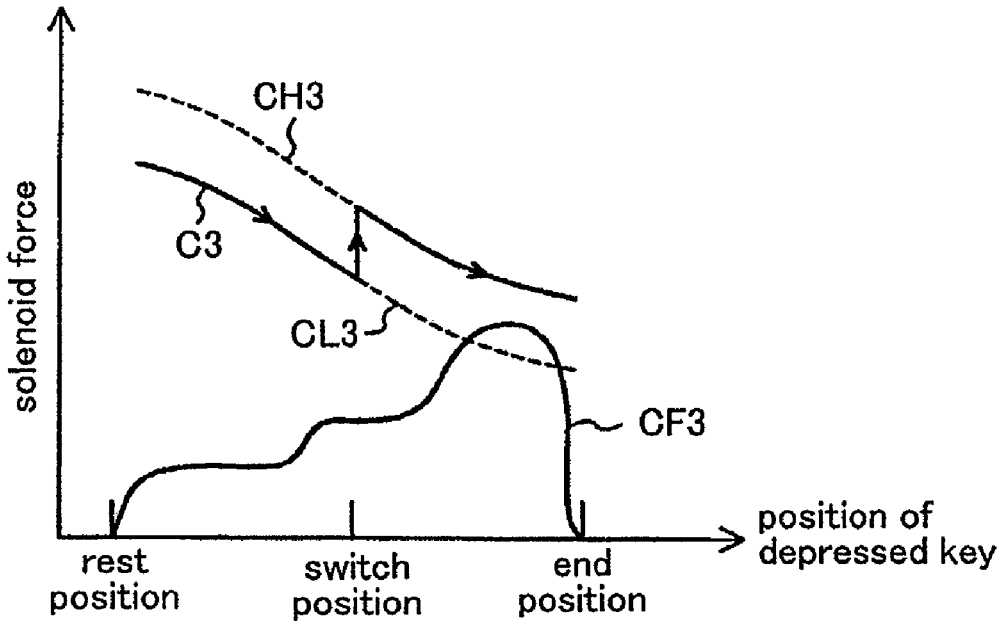
FIG. 11 is a graph schematically indicating the relationship between the key position of a depressed key, and the largest solenoid force and reaction force of the third embodiment.

FIG. 11 is a graph schematically indicating the relationship between the key position of a depressed key, and the largest solenoid force and reaction force of the third embodiment. A curve CH3 indicates the largest solenoid force of a case where the high power supply voltage VH3 is applied to the power supply voltage terminal 18 of the solenoid 33 with a certain amount of current flowing in the solenoid 33. A curve CL3 indicates the largest solenoid force of a case where the low power supply voltage VL3 is applied to the power supply voltage terminal 18 of the solenoid 33 with a certain amount of current flowing in the solenoid 33. As indicated by a solid line, a curve C3 which switches at the switch position from the curve CL3 to the curve CH3 indicates the largest solenoid force obtained by the solenoid drive scheme of the third embodiment.

A curve CF3 is an example profile of the reaction force which is to be exerted in response to a depression of the key. The reaction force profile, which is based on the touch of a piano, has a tendency, in general, to grow as the key position moves from the rest position toward the end position (as for the switch position, for example, it has a tendency to grow in the end position side), sharply decreasing in front of the end position.

As described above, the solenoid of the third (second) embodiment has a property that the solenoid force generated in the end position is smaller than that generated in the rest position, under the condition in which a certain amount of voltage is applied to the solenoid 33 with a certain amount of current flowing in the solenoid 33.

First, a case in which the low power supply voltage VL3 is constantly applied to the power supply voltage terminal 18 of the solenoid 33 from the rest position to the end position will be given as an example comparison. In the case in which the constant low power supply voltage VL3 is applied, the driving of the solenoid 33 by a certain amount of current defines the largest solenoid force. By varying the average current, the solenoid 33 will generate the solenoid force in accordance with the reaction force profile within the range of the largest solenoid force.

In the vicinity of the rest position, because the reaction force which is to be generated is small whereas the largest solenoid force is great, the largest solenoid force generated by the driving by the low power supply voltage VL3 is large enough to generate the required reaction force. In the vicinity of the end position, however, because the reaction force is large whereas the largest solenoid force is small, the largest solenoid force generated by the driving by the low power supply voltage VL3 is not large enough to generate the required reaction force. By applying the high power supply voltage VH3 which is sufficiently high to the solenoid 33 from the switch position to the end position, the solenoid driving scheme of the third embodiment allows the solenoid 33 to generate the desired largest solenoid force, enabling the solenoid 33 to generate the required large reaction force in the vicinity of the end position.

As the other example comparison, a case in which the high power supply voltage VH3 is applied constantly to the power supply voltage terminal 18 of the solenoid 33 from the rest position to the end position will be given. In order to ensure the adequate largest solenoid force from the switch position to the end position, the high power supply voltage VH3 is selected. From the rest position to the switch position, however, even though the reaction force which is smaller than that of the end position side is required, the solenoid 33 would be driven by an unnecessarily high voltage, which is not desirable in terms of reduction in power consumption, for example. By applying the low power supply voltage VL3 which is low but ensures necessary reaction force from the rest position to the switch position, the solenoid drive scheme of the third embodiment achieves reduction in power consumption, for example.

In terms of resolution of reaction force control as well, the solenoid drive scheme of the third embodiment is advantageous. The duty ratio indicative of a certain difference in reaction force increases as the largest solenoid force decreases. Consequently, as the largest solenoid force decreases, the difference in reaction force per the difference in duty ratio decreases. In other words, as the largest solenoid force decreases, it becomes easier to control reaction force on the basis of the duty ratio with high resolution.

By applying the low power supply voltage VL3 which is low from the rest position to the switch position in order to reduce the largest solenoid force, the solenoid drive scheme of the third embodiment enhances resolution of reaction force control, compared to the case in which the high power supply voltage VH3 is applied constantly.

At the switch position, the largest solenoid force varies stepwise. Therefore, the duty ratio indicative of reaction force is provided so that the duty ratio varies stepwise between the rest position side and the end position side with the switch position being interposed. As a result, the solenoid drive scheme of the third embodiment allows outputs which continuously (smoothly) vary in spite of the switch position being interposed.

d. Fourth Embodiment

Next, a keyboard musical instrument according to the fourth embodiment will be described. Similarly to the keyboard musical instrument of the third embodiment, the keyboard musical instrument of the fourth embodiment is designed to exert a reaction force on the basis of a profile of reaction force defined according to the position of the key. The arrangement of the key and the solenoid is the same as that of the third embodiment, which is indicated in FIGS. 5A and 5B.

The solenoid 33 of the third embodiment varies the largest solenoid force by switching the voltage which is to be applied to the solenoid 33 at the switch position provided in the direction in which the key is depressed. According to the fourth embodiment, however, the largest solenoid force varies in accordance with a profile of the largest solenoid force defined according to the position of the key. The fourth embodiment obtains the largest solenoid force according to the profile by controlling effective voltage which is to be applied to the solenoid 33. The solenoid drive unit 34 performs such driving.

Figure 12:
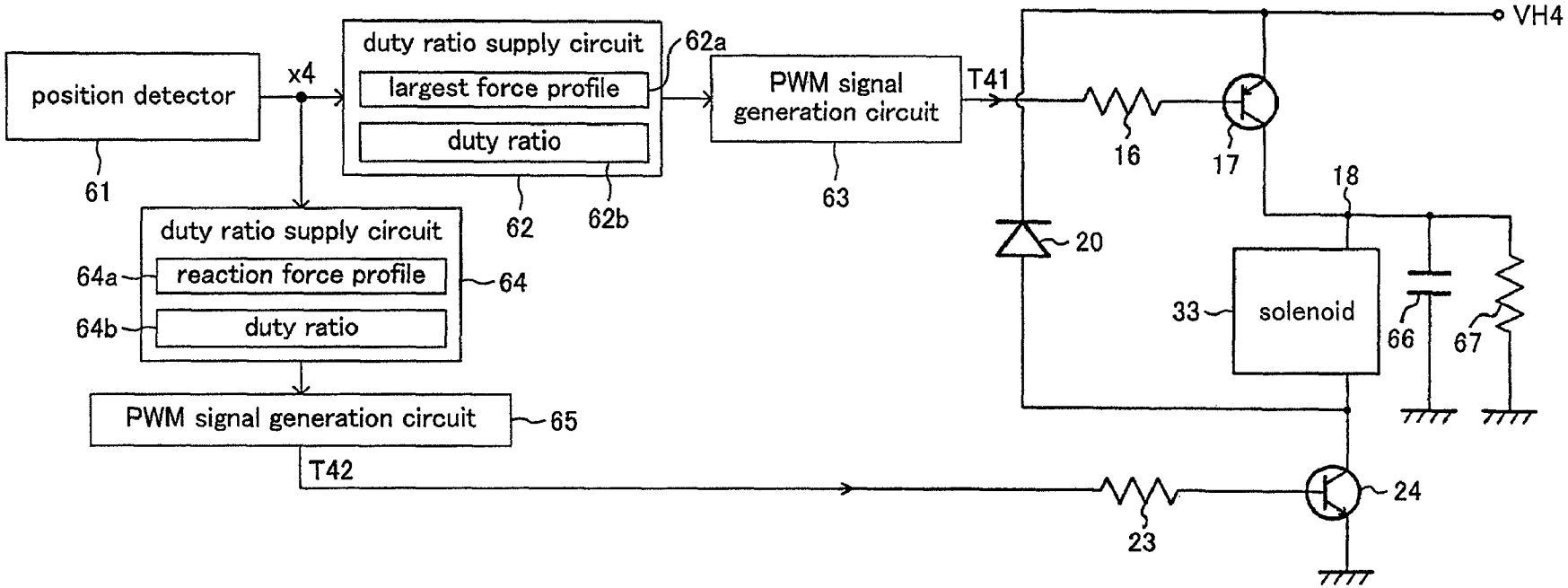
FIG. 12 is an equivalent circuit diagram indicating a schematic configuration of a solenoid drive unit of the fourth embodiment.

FIG. 12 is an equivalent circuit diagram indicating a schematic configuration of the solenoid drive unit 34 of the fourth embodiment. The resistor 16, the pnp transistor 17, the diode 20, the resistor 23 and the npn transistor 24 are connected similarly to those of the third embodiment. However, the properties of the respective elements can be appropriately selected to suit the fourth embodiment. Therefore, these elements of the fourth embodiment do not necessarily have the same properties of those of the third embodiment.

Although the third embodiment employs the power supply voltage V3 which switches between the high power supply voltage and the low power supply voltage, the fourth embodiment employs one power supply voltage (high power supply voltage) VH4 having a desired amount of voltage. The high power supply voltage does not mean a few hundred volts but a voltage which is high enough to perform duty ratio control. Letting the entire apparatuses of the above-described embodiment (e.g., FIG. 2) is driven by 24 V, for example, the high power supply voltage is the voltage of the order of 48 V which is about twice of 24 V.

Hereafter, changes brought about by the employment of one kind of power supply voltage in the fourth embodiment will be described. In addition, a control signal T41 which is to be applied to the base of the pnp transistor 17 and a control signal T42 which is to be applied to the base of the npn transistor 24 will be described.

By a player's action of depressing a key, a key-depression starts. A position detector 61 detects the position of the key and outputs a key position signal x4 indicative of the position of the key. The key position signal x4 output from the position detector 61 is input to a first duty ratio supply circuit 62 which supplies duty ratio of pulse width modulation (PWM) signal. The first duty ratio supply circuit 62 has a largest solenoid force profile table 62*a* which relates to the profile of a largest solenoid force and a duty ratio table 62*b* which relates to duty ratio. The largest solenoid force profile table 62*a* stores the profile of the largest solenoid force (for example, CH4 of FIG. 14 described later) which is to be exerted according to the key position x4, specifically stores the largest solenoid force which varies according to the key position x4. The duty ratio table 62*b* stores duty ratio for generating the largest solenoid force on the basis of the largest solenoid force profile table 62*a*, specifically stores the duty ratio which varies according to the largest solenoid force. When the key position signal x4 is input to the first duty ratio supply circuit 62 from the position detector 61, at first, the first duty ratio supply circuit 62 determines the largest solenoid force corresponding to the input key position signal x4 by referring the largest solenoid force profile table 62*a*. Next, the first duty ratio supply circuit 62 determines the duty ratio corresponding to the determined largest solenoid force by referring the duty ratio table 62*b*. As a result, the first duty ratio supply circuit 62 determines the duty ratio according to the key position x4 to supply the determined duty ratio to a first PWM signal generation circuit (energization switch signal generation circuit) 63.

According to the duty ratio supplied from the first duty ratio supply circuit 62, the first PWM signal generation circuit (voltage switch signal generation circuit) 63 generates a first PWM signal (voltage switch signal) T41. The voltage switch signal T41 is applied to the base of the pnp transistor 17. The emitter and the collector of the pnp transistor 17 are connected to the high power supply voltage VH4 and the power supply voltage terminal 18 of the solenoid 33, respectively. Between the power supply voltage terminal 18 of the solenoid 33 and a ground potential, a capacitor 66 and a resistor 67 are connected in parallel.

In accordance with the duty ratio of the first PWM signal T41, the pnp transistor 17 is repeatedly switched between on and off. In an on-state, the high power supply voltage VH4 is applied to the solenoid 33 to charge the electric charge in the capacitor 66 at the timing. In an off-state, the electric charge charged in the capacitor in the on-state flows into the solenoid 33. By such iterated switching, the effective voltage which is to be applied to the power supply voltage terminal 18 of the solenoid 33 is controlled in accordance with the duty ratio of the first PWM signal T41. As a result, the fourth embodiment controls the largest solenoid force.

The key position signal x4 output from the position detector 61 is also input to a second duty ratio supply circuit 64 which supplies duty ratio of PWM signal. The second duty ratio supply circuit 64 has a reaction force profile table 64*a* and a duty ratio table 64*b* same as the duty ratio supply circuit 53 of the third embodiment. When the key position signal x4 is input to the duty ratio supply circuit 64 from the position detector 61, at first, the duty ratio supply circuit 64 determines the reaction force (the solenoid force) corresponding to the input key position signal x4 by referring the reaction force profile table 64*a* in the same way of the case of the duty ratio supply circuit 53. Next, the duty ratio supply circuit 64 also determines the duty ratio corresponding to the determined reaction force by referring the duty ratio table 64*b*. As a result, the duty ratio supply circuit 64 determines the duty ratio according to the key position x4 to supply the determined duty ratio to a second PWM signal generation circuit (energization switch signal generation circuit) 65.

According to the duty ratio supplied from the second duty ratio supply circuit 64, the second PWM signal generation circuit (energization switch signal generation circuit) 65 generates a second PWM signal (energization switch signal) T42. The energization switch signal T42 is applied to the base of the npn transistor 24. Similarly to the third embodiment, in accordance with the duty ratio of the second PWM signal applied to the base of the npn transistor 24, the average current flowing in the solenoid 33 is controlled, so that the reaction force is generated in accordance with the reaction force profile.

Figure 13:
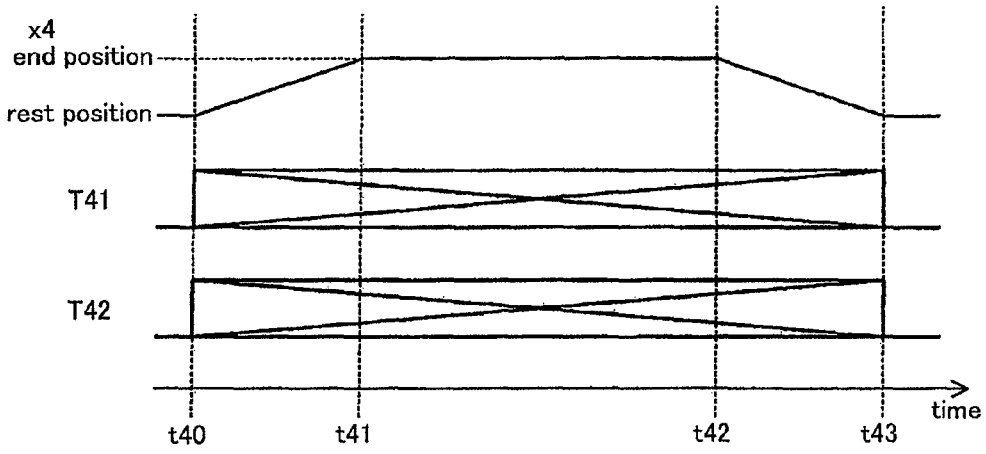
FIG. 13 is a timing chart schematically indicating a scheme for driving a solenoid of the fourth embodiment.

Referring to FIG. 13 as well, the scheme for driving the solenoid of the fourth embodiment will now be described. FIG. 13 is a timing chart schematically indicating the scheme for driving the solenoid of the fourth embodiment. FIG. 13 indicates the key position x4, the voltage switch signal T41, and the energization switch signal T42.

At time t40, the player starts a depression of a key, so that the key position x4 moves from the rest position toward the end position. The key position x4 reaches the end position at time t41, and is kept at the end position until time t42. At time t42, the player starts an action for releasing the key. At time t43, the key position x4 returns from the end position side to the rest position.

From time t40 until time t43, the voltage switch signal T41 of the first PWM signal is applied to the base of the pnp transistor 17 to control the effective voltage which is to be applied to the solenoid 33 by the duty ratios provided in accordance with the respective key positions x4. From time t40 until time t43, in addition, the energization switch signal T42 of the second PWM signal is applied to the base of the npn transistor 24 to control the average current flowing in the solenoid 33 by the duty ratios provided in accordance with the respective key positions x4.

Figure 14:
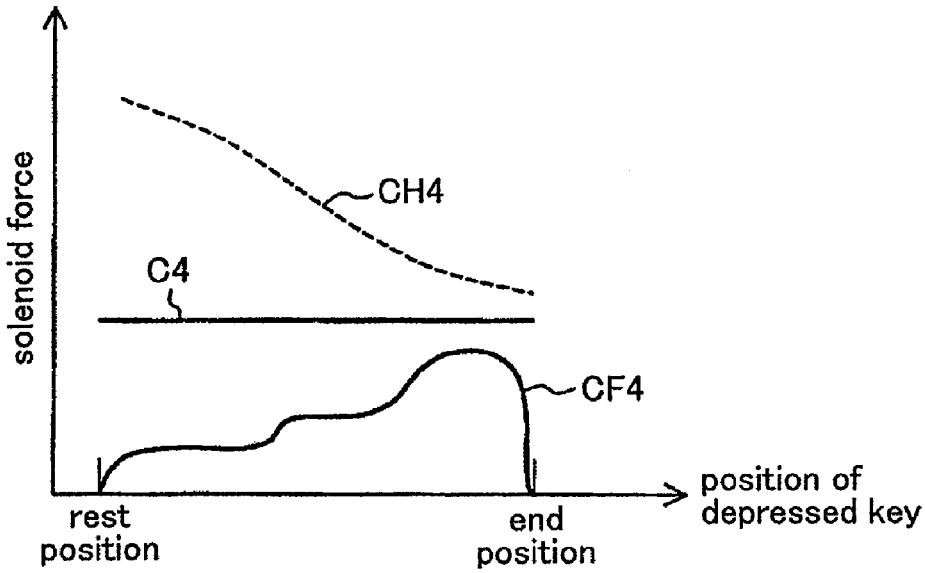
FIG. 14 is a graph schematically indicating the relationship between the key position of a depressed key, and the largest solenoid force and reaction force of the fourth embodiment.

FIG. 14 is a graph schematically indicating the relationship between the key position of a depressed key, and the largest solenoid force and reaction force of the fourth embodiment. A curve CH4 indicates the largest solenoid force of a case where the high power supply voltage VH4 is constantly applied to the power supply voltage terminal 18 of the solenoid 33 with a certain amount of current flowing in the solenoid 33. As indicated by a solid line, a curve C4 indicates the largest solenoid force obtained by the solenoid drive scheme of the fourth embodiment. A curve CF4 is an example profile of reaction force which is to be exerted in response to a depression of the key.

In this embodiment, the profile C4 indicative of the largest solenoid force is uniform regardless of the position of the key. By controlling the effective voltage within the range of the largest solenoid force obtained by the constant high power supply voltage VH4, the embodiment achieves the profile C4 of the uniform largest solenoid force. Under the condition of the profile C4 of the uniform largest solenoid force, the embodiment controls the average current to obtain the profile CF4 of the reaction force.

In the third embodiment, the largest solenoid force varies stepwise at the switch position, resulting in the duty ratios indicative of reaction force which vary stepwise between the rest position side and the end position side with the switch position being interposed. In the fourth embodiment, because the largest solenoid force is designed to be as uniform as possible, there is no need to sharply vary the duty ratio for the reaction force control at the switch position. The fourth embodiment allows smooth variations in the duty ratio according to the key position, facilitating the reaction force control, compared with the third embodiment.

Although the fourth embodiment employs the example of the profile of the uniform largest solenoid force (the profile being as uniform as possible, compared with the curve CH4), the profile of the largest solenoid force may have any shape by providing a table storing suitable duty ratios.

e. Other Modifications

Figure 15A:
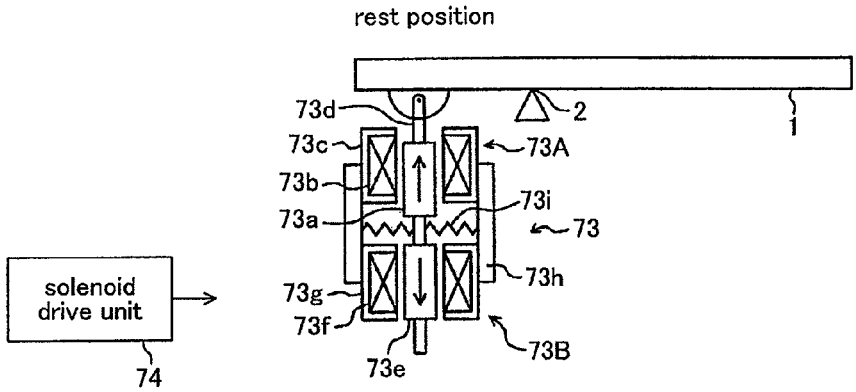
FIG. 15A is a schematic sectional view indicative of the key of a keyboard musical instrument according to the other embodiment, the key being situated at the rest position.
Figure 15B:
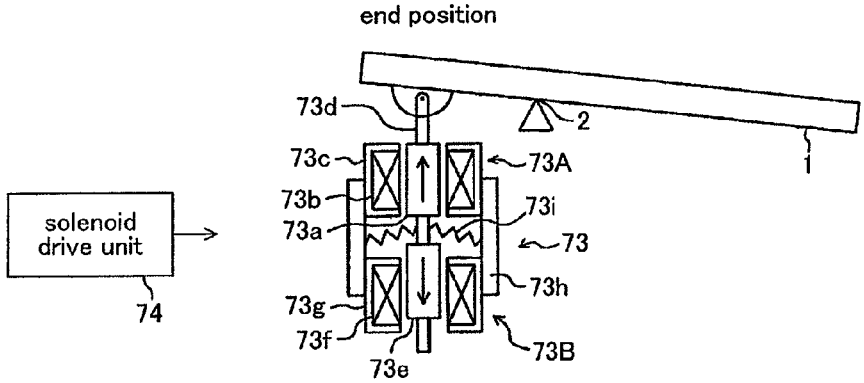
FIG. 15B is a schematic sectional view indicative of the key of the keyboard musical instrument according to the other embodiment, the key being situated at the end position.

As indicated in FIGS. 15A and 15B, a solenoid device capable both of automatic performance and exertion of sense of force may be employed in which both a push type solenoid and a pull type solenoid are arranged. Similarly to the embodiment for automatic performance indicated in FIG. 1 and the embodiment for exertion of reaction force indicated in FIG. 5, below the rear of the key 1 with respect to the fulcrum 2, a solenoid device 73 is placed.

The solenoid device 73 includes an upper push type solenoid 73A and a lower pull type solenoid 73B. The upper solenoid 73A includes a plunger 73*a*, a coil 73*b*, and a yoke 73*c*. The lower solenoid 73B includes a plunger 73*e*, a coil 73*f*, and a yoke 73*g*. The solenoid device 73 also includes a coupling rod 73*d*, a case 73*h* and a rest position recovery spring 73*i* which are used by both of the upper and lower solenoids 73A, 73B.

FIG. 15A indicates the rest position of the key 1. FIG. 15B indicates the end position of the key 1. Similarly to the description about the first embodiment, the push type solenoid 73A is used for automatic performance. Similarly to the description about the second through fourth embodiments, the pull type solenoid 73B is used for exertion of reaction force.

The case 73*h* fixes the coils 73*b*, 73*f* and yokes 73*c*, 73*g*. The rest position recovery spring 73*i* connects the coupling rod 73*d* to the case 73*h*. The rest position recovery spring 73*i* exerts a force which returns the coupling rod 73*d* and the plungers 73*a*, 73*e* installed on the coupling rod 73*d* which have moved toward the end position side to the rest position.

A solenoid drive unit 74 drives the solenoid for automatic performance of the first embodiment or (and) the solenoid for exertion of reaction force of the second embodiment and the like. The solenoid drive unit 74 may share components of solenoid drive circuits between the automatic performance and the exertion of reaction force.

The push type solenoid may be used in order to exert, in response to a player's depression of a key, a force in the direction in which the key is depressed to provide the player with a sense of force which makes the player recognize that the key becomes light.

As needed, furthermore, the force which is to be exerted on a key on a player's release of the key and the force which is to be exerted on a key on a depression or release of the key by automatic performance can be changed on the basis of the position of the key in accordance with a desired profile.

In the above-described third and forth embodiments, the duty ratio supply circuits 53, 64 have the reaction force profile table 53*a*, 64*a* and the duty ratio table 53*b*, 64*b* respectively, and the duty ratio supply circuit 63 has the largest solenoid force profile table 62*a* and the duty ratio table 62*b*. However, the duty ratio supply circuits 53, 62, 64 may have only a duty ratio table for storing duty ratio which varies according to the key position x3 or x4, in order to obtain duty ratio according to a reaction force profile or a largest solenoid force profile. In this case, the duty ratio supply circuits 53, 62, 64 directly determine duty ratio according the input key position signal x3, x4 to supply the determined duty ratio to the PWM signal generation circuits (energized switch signal generation circuits) 54, 63, 65. Further, the reaction force profile table 53*a*, 64*a* also may be provided in the duty ratio supply circuits 53, 64 respectively and the largest solenoid force profile table 62*a* also may be provided in the duty ratio supply circuit 62. Although these profile tables 53*a*, 62*a*, 64*a* are used in order to display, confirm and edit characteristics of the varying reaction force or the varying largest solenoid force and in order to create the table 53*b*, 62*b*, 64*b* storing duty ratio, these profile tables 53*a*, 62*a*, 64*a* are not used for actual control based on the duty ratio.

In the above-described embodiments, the solenoid is applied to the keyboard musical instrument. However, the control of solenoid force explained in the above-described embodiments may be applied to other fields such as game apparatuses and medical apparatuses.

Although the present invention has been described on the basis of the embodiments, the present invention is not limited to the above-described embodiments. It is obvious to persons skilled in the art that various modifications, improvements, combinations and the like are possible.

What is claimed is:

1. A keyboard musical instrument comprising:

a solenoid having a plunger and a coil into which the plunger is inserted;

a drive unit for applying voltage to the solenoid; and a key which moves together with the plunger, and which is driven by the solenoid for an action of depression of the key, wherein the plunger is arranged in the solenoid such that a force generated by the solenoid at a finish position where the action of depression of the key finishes is larger than that generated at an initial position of the key where the key is situated before the action of depression of the key in a case where a certain amount of voltage is applied to the solenoid with a certain amount of current flowing in the solenoid;

the drive unit includes a position detector for detecting position of the key in a direction in which the key is depressed or released; and the drive unit applies a first voltage to the solenoid until the position of the key detected by the position detector reaches a first key position situated at some point in a depression of the key, and applies a second voltage which is lower than the first voltage after the key first key position, the first voltage and the second voltage being provided as power supply voltage.

2. A keyboard musical instrument comprising:

a solenoid having a plunger and a coil into which the plunger is inserted;

a drive unit for applying voltage to the solenoid; and a key which moves together with the plunger, and which is depressed by a player, wherein the solenoid exerts, on the key, a reaction force which resists the player's depression of the key;

the drive unit includes a position detector for detecting position of the key in a direction in which the key is depressed or released; and the drive unit applies a first voltage to the solenoid until the position of the key detected by the position detector reaches a first key position situated at some point in the depression of the key, and applies a second voltage which is different from the first voltage after the first key position, the first voltage and the second voltage being provided as power supply voltage, wherein a change from the first voltage to the second voltage causes a sharp change in the reaction force.

* * * * *